United States Patent [19]

Snellman et al.

[11] Patent Number: 4,548,398

[45] Date of Patent: Oct. 22, 1985

[54] COLLATOR

[75] Inventors: Donald L. Snellman, 2807 W. Galer St., Seattle, Wash. 98199; Bernard A. Pearson, Bothell, Wash.

[73] Assignee: Donald L. Snellman, Seattle, Wash.

[21] Appl. No.: 464,417

[22] Filed: Feb. 7, 1983

Related U.S. Application Data

[63] Continuation of Ser. No. 209,045, Nov. 21, 1980, abandoned.

[51] Int. Cl.[4] ..... B65H 29/14; B65H 29/60

[52] U.S. Cl. ..... 271/197; 271/216

[58] Field of Search ..... 271/296, 297, 287, 197, 271/276, 94, 160, 95, 96, 272, 273, 274; 198/689, 811, 859; 105/153; 104/246; 270/58; 414/73; 192/48.2, 51

[56] References Cited

U.S. PATENT DOCUMENTS

| | | | |
|---|---|---|---|
| Re. 6,745 | 11/1875 | Heyl et al. | 271/160 X |
| 2,729,834 | 1/1956 | Emrick | 192/51 |
| 2,813,637 | 11/1957 | Perry et al. | 271/197 X |
| 3,202,302 | 8/1965 | Insolio | 271/197 |
| 3,372,922 | 3/1968 | Snellman et al. | 271/296 |
| 3,428,308 | 2/1969 | Bernard | 271/273 |
| 3,561,753 | 2/1971 | Snellman | 271/296 X |
| 3,854,419 | 12/1974 | Cocroft | 105/153 |
| 4,012,032 | 3/1977 | Rogers | 271/296 X |
| 4,068,837 | 1/1978 | Lamos | 271/296 X |
| 4,273,326 | 6/1981 | Snellman et al. | 271/296 |
| 4,315,621 | 2/1982 | Snellman | 271/296 |
| 4,349,190 | 9/1982 | Kaneko et al. | 271/297 |

FOREIGN PATENT DOCUMENTS

| | | | |
|---|---|---|---|
| 103999 | 2/1963 | Netherlands | 271/197 |

*Primary Examiner*—Bruce H. Stoner, Jr.
*Assistant Examiner*—James E. Barlow
*Attorney, Agent, or Firm*—Seed and Berry

[57] ABSTRACT

An improved collator uses a novel sliding deflector assembly to allow greater spacing between the sheet conveyor 13 and trays 23. It also uses a novel sheet retention system which winds or unwinds as the sliding deflector assembly moves. The sliding deflector assembly may be driven with a double-clutch drive in increments in either direction. An improved plenum of the vacuum sheet-conveying system of the collator has a novel hole-spacing series to reduce noise and power demands for the vacuum system.

10 Claims, 7 Drawing Figures

FIG. 3
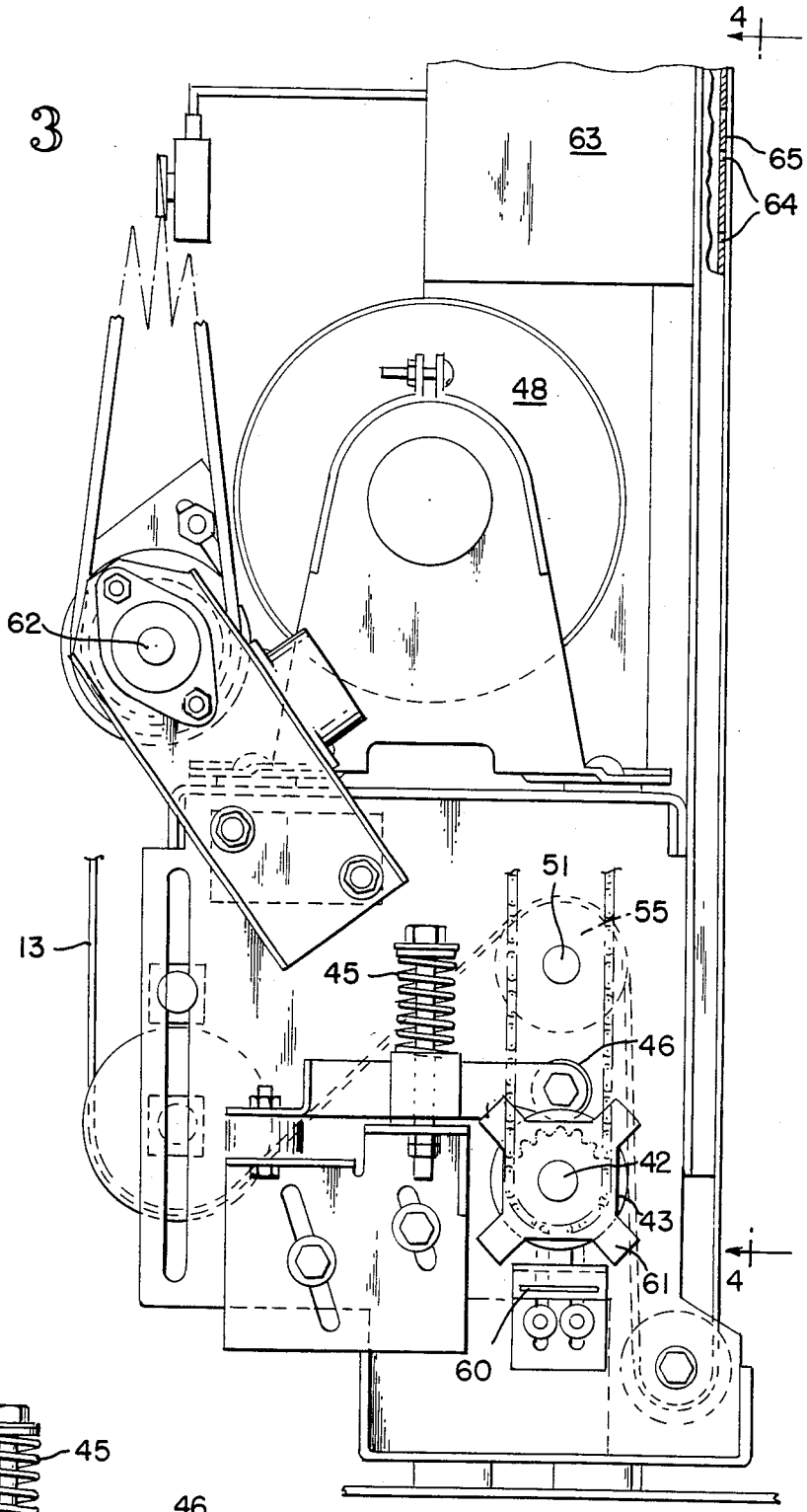
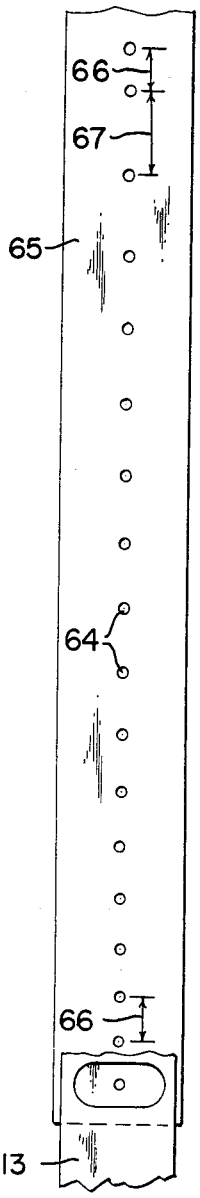
FIG. 4
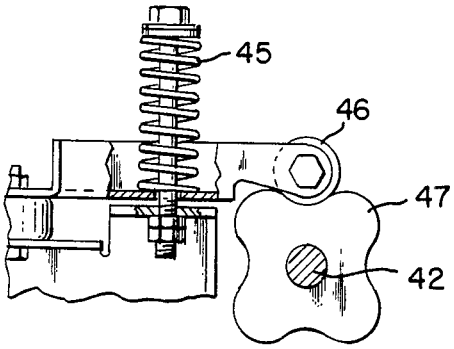
FIG. 5

FIG. 6
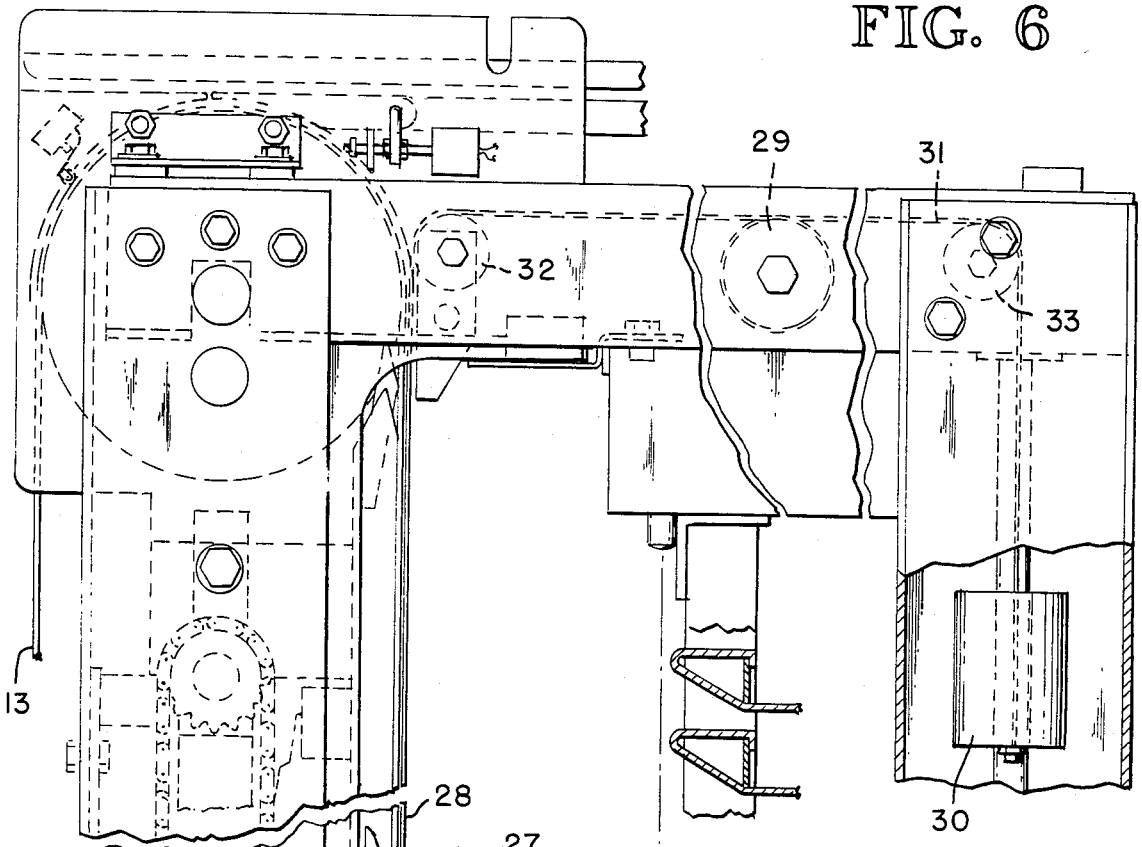
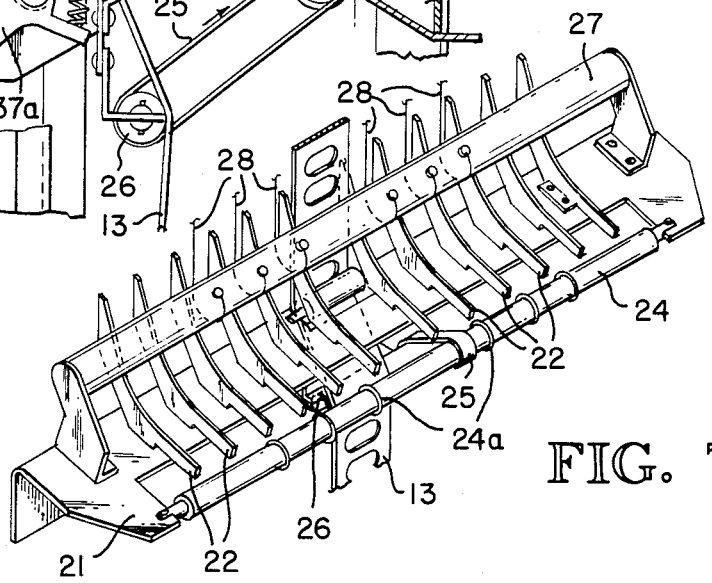
FIG. 7

COLLATOR

This application is a continuation of U.S. patent application Ser. No. 209,045, filed Nov. 21, 1980 now abandoned.

TECHNICAL FIELD

This invention relates to an improved collator having a sheet conveyor and a sliding deflector assembly to deflect sheets from the conveyor into a tray. Improvements in the design allow improved processing with reduced noise and power demands.

BACKGROUND ART

Steady improvement in collator technology has given rise to numerous patents on various features and combinations. Even with this activity, novel advances are still desirable to improve the collator's efficiency through such steps as noise reduction, reduction of power consumption, and increasing versatility for the machine. A representative list of the existing state of the art in collators is shown in five United States patents: U.S. Pat. No. 3,372,922 (Snellman et al.); U.S. Pat. No. 3,414,254 (Snellman et al.); U.S. Pat. No. 3,561,753 (Snellman); U.S. Pat. No. 3,765,670 (Johnson); and U.S. Pat. No. 3,848,867 (Johnson). The collator of this invention is an improvement in several features of the collator art. The referenced patents are incorporated by reference to gain the benefit of their teachings on common collator features and mechanics.

DISCLOSURE OF THE INVENTION

A preferred collator of this invention features a novel sliding deflector assembly that allows the trays to be spaced further away from the collator. The additional spacing allows an operator to clear sheet jams more easily. The novel sliding deflector assembly has a base which extends across the sheet conveyor, a plurality of arcuate teeth capable of contacting a sheet on the sheet conveyor to deflect it toward a tray, and a driven roller positioned on the base at the end of the teeth to contact deflected sheets and to drive them into a tray. The driven roller has a cylinder at the end of the teeth which is driven by an endless belt. the belt wraps around a second cylinder, which, in turn, is driven by the conveyor belt. This simplified drive increases the momentum of the paper so that there is a greater likelihood that it will enter the tray.

The sliding deflector assembly tracks along V-grooves on the collator in a customary fashion, with two pairs of wheels straddling a support. To reduce noise in movement and to self-tighten the roller means, the sliding deflector assembly's roller means has one pair of wheels biased apart with a support/bar/damper combination. A coil spring pushes two members pivotally attached in an intermediate portion of both members, such like a pair of scissors.

The sliding deflector assembly also has a novel system for retaining sheets being conveyed against the sheet conveyor. The retaining means are suitable monofilament lines similar to fishing line. The lines extend upwardly from a mounting means on the sliding deflector assembly above the teeth adjacent to at least a portion of the sheet conveyor to help hold sheets on that portion. As the sliding deflector assembly moves, the lines wind or unwind from a means mounted on the collator. Preferably, the means is a spool about which the lines wrap. To wind automatically when the sliding deflector assembly rises, a counterweight is suspended from the spool to rotate it and to remove slack.

Furthermore, the improved collator of this invention uses a novel plenum as a part of the vacuum conveying system of the collator to reduce noise and power consumption. The plenum has a series of spaced openings flush with its surface (rather than countersunk). For each set of openings in a non-repeating series, the spacing gradually and systematically increases from an initial spacing to a final spacing twice the initial. Then the series repeats. The gradual increase eliminates resonance developing for the suction. Preferably, the initial spacing is about $\frac{1}{2}$–$\frac{5}{8}$ inch, with an increment between subsequent openings of an additional 1/32 inch.

To allow the sliding deflector assembly to be driven in increments in either direction, the collator of this invention uses a double-clutch drive. Each clutch may be engaged to drive a shaft connected with the conveyor belt drive chain. A cam functions as a brake for the drive shaft. These and other features will be more fully described and shown in the following description. Through several improvements, the collator of this invention provides a machine with improved operating characteristics, lower noise, and reduced power consumption.

BRIEF DESCRIPTION OF THE DRAWINGS

FIG. 3 is a partial section taken along line 3—3 of FIG. 1 showing a second view of the drive means of the collator.

FIG. 4 is a partial section taken along line 4—4 of FIG. 3 showing the improved plenum of the vacuum conveyor system of this invention.

FIG. 5 is a partial section taken along line 5—5 of FIG. 2 showing a spring clip means on the drive assembly.

FIG. 6 is a partial section taken along line 6—6 of FIG. 1 showing the sliding deflector assembly and sheet retention system.

FIG. 7 is an elevation of the sliding deflector assembly.

BEST MODE FOR CARRYING OUT THE INVENTION

Figure 1:
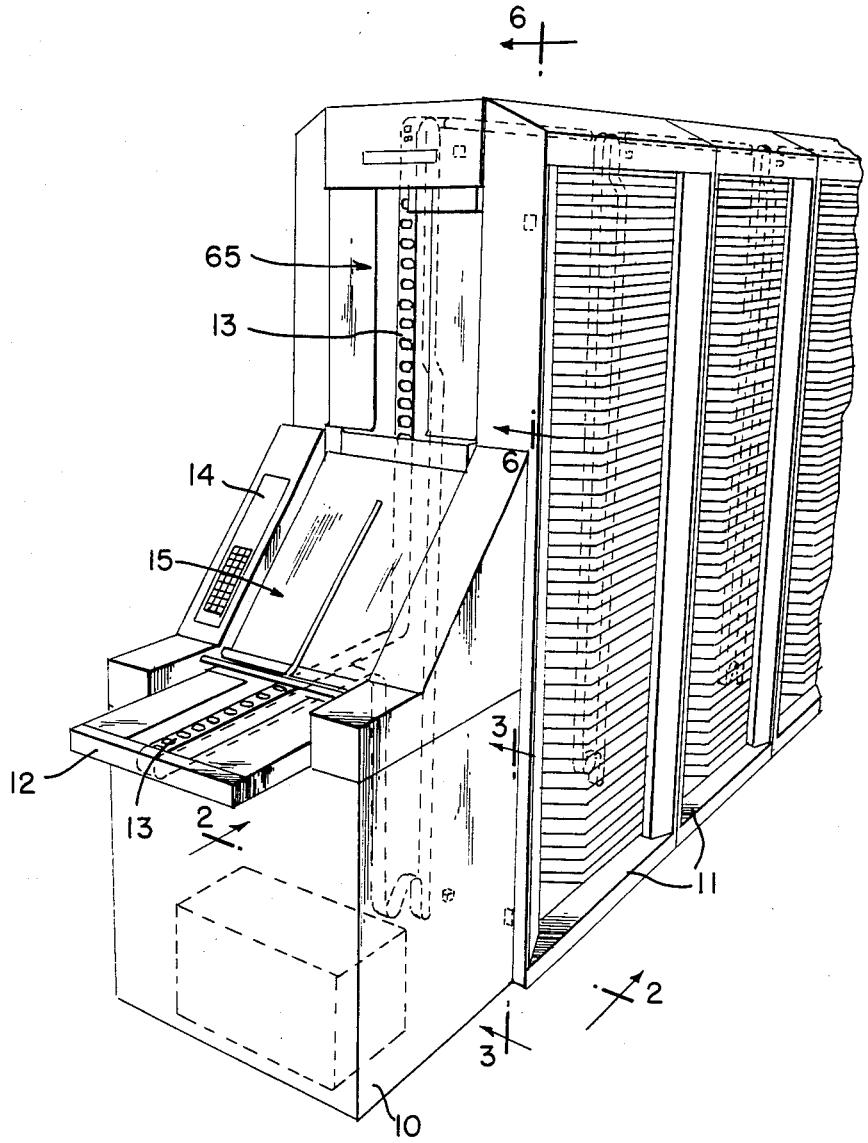
FIG. 1 is a perspective view of a collator embodying this invention.

Referring now to FIG. 1, the collator of this invention has a console 10 with bin units 11 attached in tandem. A sheet entry 12 may be adjusted vertically to accommodate a variety of feeders (not shown). A sheet conveyor belt 13 transports sheets entering from a feeder either to the bin units 11 or to a proof tray 15. Input commands, specifying the job size, mode, and distribution of sheets, may be accomplished by activating switches located on instrument panel 14 of the console 10.

As best seen in FIGS. 6 and 7, the sliding deflector assembly for use in the collator of this invention comprises a base 21 to which are attached a plurality of arcuate teeth 22 capable of contacting sheets retained against the conveyor belt 13 and of deflecting them toward a tray 23 of one of the bin units. To insure that the deflected sheets reach the desired trays, the sliding deflector assembly employs a drive means comprising a first driven cylinder 24 positioned at the end of the teeth 22 to contact sheets. The cylinder 24 is driven by a belt 25 which wraps around a second cylinder 26. The second cylinder 26 is driven by conveyor belt 13. O-rings 24*a* sponge rubber are secured at spaced intervals around the cylinder 24 to increase the friction between the sheets and the drive means and insure that sufficient thrust is provided to the sheet. The driven cylinder 24 enables the sheets being conveyed to bridge the gap between the deflector assembly and the trays without jamming. Additionally, as the deflector assembly travels upwardly, the driven cylinder 24 contacts the terminating edge of any sheet which may not be fully in a tray to move it completely into the tray.

The sheets being conveyed are retained against the conveyor belt 13 by a series of laterally spaced retainers, such as monofilament lines 28. The lines are attached at one end to cylindrical means 27 attached to the base 21 above the teeth 22. Lines 28 extend upwardly from the sliding deflector assembly to a means for winding and unwinding, shown as a spool 29 about which the lines wrap. To rewind automatically when the sliding deflector assembly rises, a counterweight 30 is suspended from a cable 31 attached to the spool 29. Gravity removes slack in the system. To insure that little damage is done to either the lines 28 or cable 30 during winding or unwinding, sheaves 32 and 33 are rotatably mounted to the collator's frame.

The sliding deflector assembly moves upwardly and downwardly along a grooved track 34 positioned on opposite edges of the sheet conveyor belt 13. Pairs of wheels 35 and 36 straddle the groove 34 to allow movement while holding the sliding deflector assembly steady. To reduce noise and to make the wheels self-tightening, the wheels preferably have a damper associated with one pair of wheels 35. Two supports 37 and 37*a* are pivotally attached to one another and to the respective wheels 35, much the same as the attachment for scissors. A spring coil 38 biases the two supports 37 and 37*a* apart. This simple device makes the wheels 35,36 roll more quietly because they are restricted from vibrating and are dampened with the spring.

Figure 2:
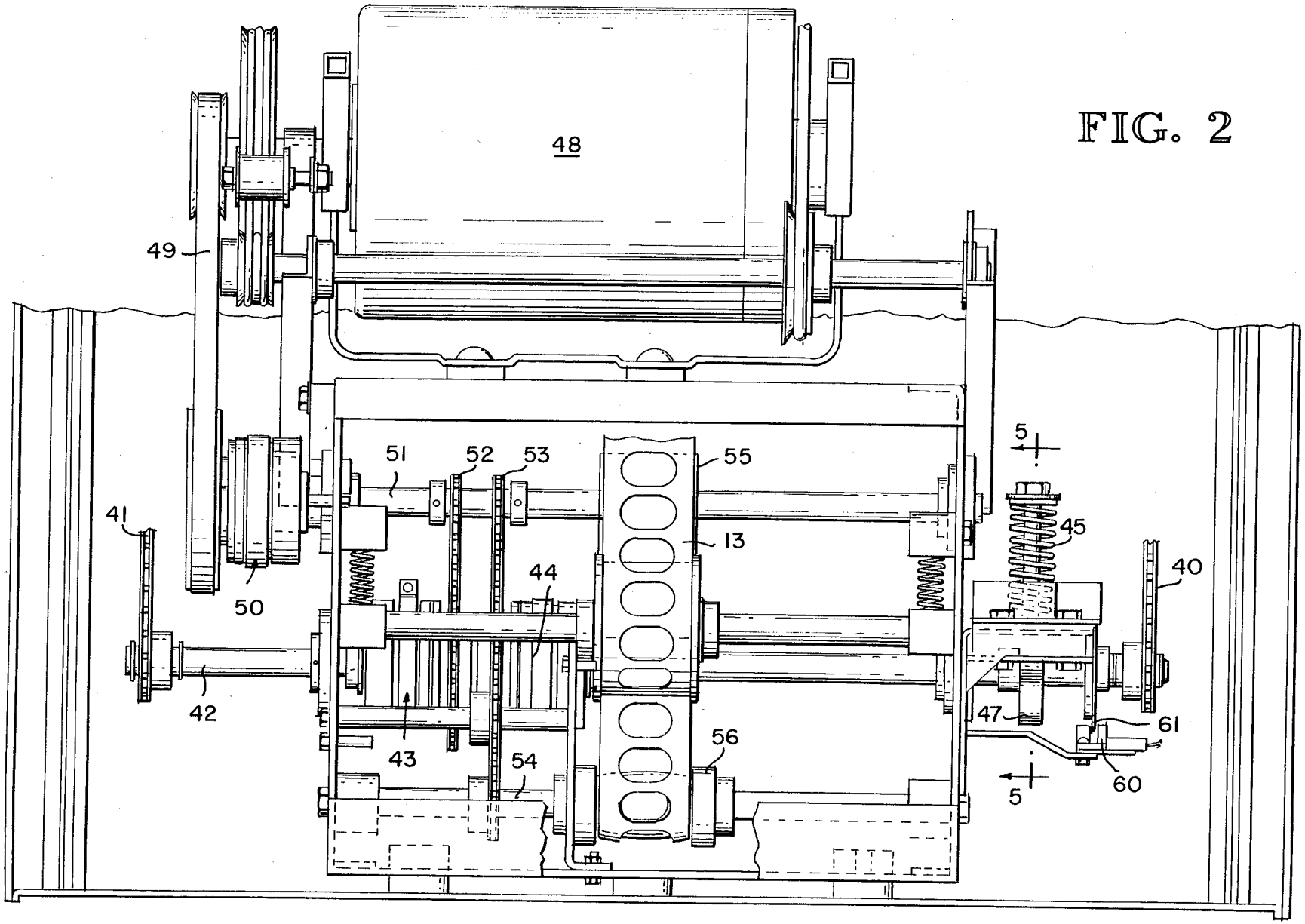
FIG. 2 is a partial section taken along line 2—2 of FIG. 1 showing the drive means for a the collator.

FIGS. 2, 3, and 5 show the drive means for the collator. Chains 40 and 41 form endless belts on both sides of the conveyor belt 13 and sliding deflector assembly. Shaft 42 is turned to move the sliding deflector assembly along the conveyor belt 13. Two clutches 43 and 44 allow positive drive in either direction. To serve as a brake, a spring 45 applies downward pressure upon a cam follower 46 which slides over a cam 47 mounted on shaft 42. The lobes of the cam 47 act as stops for the shaft when the deflector assembly moves from tray to tray. Without the lobes, the shaft 42 would tend to spin. The small resistance of the lobes stops rotation of shaft 42 unless the clutch is engaged. The clutches 43 and 44 preferably are Warner Electric magnetic pulled-in friction clutches, available from Inertia Dynamics as Model No. SL-22-16-603. They are positioned opposing one another and connected so that one may be engaged while the other is disengaged. Suitable drive means for the drive shaft 42 allow rotation in either a clockwise or counterclockwise direction, depending upon which clutch 43 or 44 is engaged. For example, motor 48 drives shaft 51 through V-belt 49 and clutch 50. Roller chain 52 directly drives shaft 42. The conveyor belt 13 passes over knurled rollers 55 and 56 so that it moves when the shaft 42 is turned. A sprocket on the clutch 43 engages the roller chain 52. To drive the shaft 42 in the opposite direction, the idler chain 53 engages only one side of the sprocket on clutch 44. A closed loop for the idler chain 53 is formed as the chain 53 passes around shafts 51 and 54. Because the chain engages only one side of the sprocket on clutch 44, the chain 53 drives the clutch 44 in the opposite direction from the direct drive of the roller chain 52.

A Hall effect sensor 60 and a star wheel 61 are mounted on shaft 42 (see FIG. 3) so that the collator may keep track of the position of the sliding deflector assembly. For each time the deflector assembly moves one tray, the magnetic field between the two halves of the Hall effect sensor 60 is cut by the star wheel 61. Cutting the field produces a signal which the collator processes to count the tray arrived at and to disengage the driving clutch 43 or 44. The sensor 60 serves as a switch, then, for the drive disengaging it for each interruption. A microprocessor preferably processes the sensed information and controls the electromechanical means of the collator.

As shown in FIG. 4, an improved plenum 65 of the vacuum sheet-transport system of the collator has a novel arrangement of openings 64 flush with the surface along it. This arrangement allows use of a smaller vacuum motor 62 to drive the suction fan 63. The spacing also reduces the noise otherwise generated by the collator. The openings 64 form a repeating series. The initial spacing 66 between two openings increases by a small increment until the space 67 between two openings is twice the initial spacing. Preferably, the initial spacing is about $\frac{1}{2}$–$\frac{5}{8}$ inch, with an increment of 1/32 inch for each successive opening 64. With a series of this type, resonance is eliminated. The flush openings inhibit airflow through the plenum. With countersunk openings, the airflow was made easier so a larger motor had to be used to create a vacuum suction that would hold sheets on the conveyor.

Many modifications are possible for the embodiments shown and described in this application. Therefore, this invention should not be limited to a particular embodiment unless limitation is required because of the prior art or the spirit of the following claims.

What is claimed is:

1. A vacuum sheet-transport system for transporting sheets with less noise and reduced power requirements, comprising:

an elongated plenum longitudinally elongated in the direction of sheet travel, the plenum having a planar surface with at least one longitudinally extending series of openings extending along the longitudinal dimension of the plenum, the openings being flush with the plenum surface and being spaced apart so that the distance between successive openings in the series gradually and systematically increases from an initial spacing to a spacing twice as wide as the initial, and a sheet conveyor belt positioned for travel over the planar surface in the direction of sheet travel and aligned with the openings, the belt having a plurality of regularly spaced openings of considerably greater diameter than the openings in the plenum which pass over the openings in the plenum.

2. The vacuum sheet-transport system of claim 1 wherein the first two openings are spaced apart between about $\frac{1}{2}$–$\frac{5}{8}$ inch, each additional opening spaced an additional 1/32 inch from the preceding opening in the series.

3. A collator comprising a plurality of stacked trays, each having an open end, a conveyor system adapted to feed sheets to the trays, the system including a conveyor belt, and a deflector associated with the belt to deflect sheets from the system into a tray through its open end, further comprising an elongated plenum longitudinally elongated in the direction of sheet travel, the plenum capable of reducing noise and power requirements, having a planar surface over which the conveyor belt travels, the surface having at least one series of spaced openings within it, the openings extending longitudinally along the surface and being aligned with the belt, each series having a plurality of openings, the first two openings spaced apart between about $\frac{1}{2}$–$\frac{5}{8}$ inch, each additional opening spaced an additional 1/32 inch further away from the preceding opening in the series.

4. The collator of claim 3, further comprising a plurality of spaced lines extending to the deflector adjacent to at least a portion of the belt from a spool rotatably mounted on the collator, with the lines wrapped about the spool, and a counterweight suspended from the spool to rewind the lines about the spool when the deflector rises.

5. A collator as defined in claim 3 wherein the spaced openings are flush with the plenum surface and the spacing gradually and systematically increases from an initial spacing to a spacing twice as wide as the initial.

6. A collator as defined in claim 3, further comprising a clutch/drive mechanism having a pair of opposed clutches coaxially mounted on a shaft which drives the deflector from tray to tray so that one clutch is engageable when the other is disengaged, means for driving the shaft both clockwise and counterclockwise by engaging a respective clutch, and a brake to stop rotation of the shaft when neither clutch is engaged, the brake having a spring to press a cam follower against a lobed cam on the shaft.

7. The collator of claim 3, wherein the deflector includes:

(a) a base which tracks beside at least a portion of the belt adjacent the entry to the stacked trays;

(b) a plurality of arcuate teeth attached to the base and capable of contacting sheets transported on the belt to deflect each sheet toward a tray;

(c) a driven roller positioned on the base to contact sheets after deflection by the teeth to drive them into the tray;

(d) grooved tracks positioned at opposite sides of the base to straddle the sheet conveyor;

(e) at least two roller assemblies capable of tracking along grooves in the tracks, one roller assembly for each track, wherein each roller assembly includes two bars pivotally connected together between ends of the bars, a wheel connected to one end of each bar, and a damper disposed between the other ends of the bars opposite the wheels for forcing the wheels apart by biasing the bars apart.

8. The collator of claim 3 wherein the deflector includes:

(a) a base which tracks beside at least a portion of the belt adjacent the entry of the stacked trays;

(b) a plurality of spaced, arcuate teeth attached to the base and adapted for contacting sheets transported on the belt to deflect each sheet toward a tray, each tooth having a first end for contacting a sheet on the belt and a second end which points to the tray, the teeth being positioned in generally parallel array so that the first end of each tooth contacts the sheet at substantially the same time; and (c) a driven roller assembly mounted on the base to contact sheets after deflection by the teeth to drive the sheets into the tray, including a first cylinder rotatably mounted on the base immediately between the second ends of the teeth and the tray, a second cylinder positioned so that it is rotated by the sheet conveyor when the sheet conveyor moves, and an endless belt coupling the first and second cylinders so that the second cylinder rotates with the first cylinder.

9. The collator of claim 8, the deflector further including a plurality of O-rings around the first cylinder to increase the friction between the sheet and the cylinder so that the sheet will be positively driven into the tray.

10. A collator including a sheet conveyor to transport sheets to a tray in a bin comprising:

a vacuum sheet transport system, the vacuum transport system including an elongated plenum longitudinally elongated in the direction of sheet travel, having openings therein extending along the lengthwise dimension of the plenum flush with the plenum surface and spaced apart so that the distance between successive openings in the series gradually and systematically increases from an initial spacing of the first two openings spaced apart between $\frac{1}{2}$–$\frac{5}{8}$ inch with additional openings in the series spaced an additional 1/32 inch away from the preceding opening in the series so that the spaced openings gradually and systematically increase from an initial spacing to a spacing twice as wide as the initial spacing; a sheet conveyor having a plurality of regularly spaced openings of greater diameter than the openings in the plenum passing over the openings in the plenum in the direction of sheet travel; a sliding deflector assembly to move a sheet from the sheet conveyor to a tray, the sliding deflector assembly comprising (a) a base which tracks beside at least a portion of the sheet conveyor adjacent the trays, (b) a plurality of arcuate teeth attached to the base and capable of contacting sheets transported on the sheet conveyor to deflect them toward a tray, and (c) a driven roller positioned on the base to contact deflected sheets leaving the teeth to drive them into the tray; the collator further comprising (1) a plurality of lines attached to the deflector assembly above the teeth and extending adjacent the sheet conveyor to a means for winding and unwinding mounted on the collator, wherein the means for winding and unwinding includes a spool rotatably mounted to the collator about which lines wrap, and a counterweight suspended from the spool to rewind the lines as the deflector assembly rises, and (2) a clutch/drive mechanism having (a) a pair of opposed clutches coaxially mounted on a shaft which drives the deflector assembly from tray to tray so that one clutch is engageable when the other is disengaged, (b) means for driving the shaft both clockwise and counterclockwise by engaging a respective clutch, and (c) a brake to stop rotation of the shaft when neither clutch is engaged, the brake having a spring to press a cam follower against a lobed cam on the shaft.

* * * * *